US011373487B2

(12) United States Patent
Hosokawa et al.

(10) Patent No.: US 11,373,487 B2
(45) Date of Patent: Jun. 28, 2022

(54) AUTOMATIC TELLER MACHINE, TERMINAL DEVICE, AND MEDIUM READING METHOD

(71) Applicant: NEC Corporation, Tokyo (JP)

(72) Inventors: Tatsuro Hosokawa, Tokyo (JP); Jun Kondo, Tokyo (JP); Naoki Morishita, Tokyo (JP); Yutaro Kitahata, Tokyo (JP)

(73) Assignee: NEC CORPORATION, Tokyo (JP)

( * ) Notice: Subject to any disclaimer, the term of this patent is extended or adjusted under 35 U.S.C. 154(b) by 21 days.

(21) Appl. No.: 16/771,952

(22) PCT Filed: Oct. 19, 2018

(86) PCT No.: PCT/JP2018/039025
§ 371 (c)(1),
(2) Date: Jun. 11, 2020

(87) PCT Pub. No.: WO2019/116724
PCT Pub. Date: Jun. 20, 2019

(65) Prior Publication Data

US 2021/0074131 A1 Mar. 11, 2021

(30) Foreign Application Priority Data

Dec. 12, 2017 (JP) ..... JP2017-237932

(51) Int. Cl.
*G07F 19/00* (2006.01)

(52) U.S. Cl.
CPC ..... *G07F 19/205* (2013.01); *G07F 19/207* (2013.01)

(58) Field of Classification Search
CPC ..... G06Q 20/1085; G07F 19/00; G07F 19/20; G07F 19/205; G07F 19/207
USPC ..... 235/379; 705/43
See application file for complete search history.

(56) References Cited

U.S. PATENT DOCUMENTS

| | | | | |
|---|---|---|---|---|
| 8,978,868 | B2 * | 3/2015 | Johnson | G07D 11/22 194/344 |
| 2011/0176137 | A1 | 7/2011 | Gerigk et al. | |
| 2014/0146334 | A1 | 5/2014 | Yuzawa | |
| 2016/0191197 | A1 * | 6/2016 | Ray | H04K 3/45 235/435 |
| 2021/0019719 | A1 * | 1/2021 | Kraft | G07F 19/2055 |

FOREIGN PATENT DOCUMENTS

| | | | |
|---|---|---|---|
| JP | H09-231446 | A | 9/1997 |
| JP | H10-063917 | A | 3/1998 |
| JP | 2002-008112 | A | 1/2002 |

(Continued)

OTHER PUBLICATIONS

International Search Report for PCT Application No. PCT/JP2018/039025, dated Nov. 27, 2018.

(Continued)

*Primary Examiner* — Suezu Ellis
(74) *Attorney, Agent, or Firm* — Sughrue Mion, PLLC

(57) ABSTRACT

An automatic teller machine includes: a first reading sensor that reads display information displayed on a medium at a predetermined position; and a second reading sensor that reads, from the medium at the predetermined position, storage information stored in the medium. The first reading sensor is disposed above the second reading sensor.

11 Claims, 5 Drawing Sheets

(56) References Cited

FOREIGN PATENT DOCUMENTS

| | | | |
|---|---|---|---|
| JP | 2002-269369 | A | 9/2002 |
| JP | 2005-184361 | A | 7/2005 |
| JP | 2010-072813 | A | 4/2010 |
| JP | 2010-282263 | A | 12/2010 |
| JP | 2011-123722 | A | 6/2011 |
| JP | 2012-059301 | A | 3/2012 |
| JP | 2012-505532 | A | 3/2012 |
| JP | 2013-026763 | A | 2/2013 |
| JP | 2013-191922 | A | 9/2013 |
| JP | 2014-093013 | A | 5/2014 |
| JP | 2014-106481 | A | 6/2014 |
| JP | 2017-111634 | A | 6/2017 |
| JP | 2017-187974 | A | 10/2017 |
| JP | 2017-215724 | A | 12/2017 |
| KR | 10-0897791 | B1 | 5/2009 |

OTHER PUBLICATIONS

Japanese Office Action for JP Application No. 2017-237932 dated Jan. 22, 2019 with English Translation.
Japanese Office Action for JP Application No. 2017-237932 dated Jun. 18, 2019 with English Translation.
Japanese Office Action for JP Application No. 2017-237932 dated Dec. 24, 2019 with English Translation.
Seven Bank LTD., 4th generation ATM store bring-in verification results (flash report), Nov. 28, 2017, Japan, with partial translation.

* cited by examiner

AUTOMATIC TELLER MACHINE, TERMINAL DEVICE, AND MEDIUM READING METHOD

This application is a National Stage Entry of PCT/JP2018/039025 filed on Oct. 19, 2018, which claims priority from Japanese Patent Application 2017-237932 filed on Dec. 12, 2017, the contents of all of which are incorporated herein by reference, in their entirety.

TECHNICAL FIELD

The present invention relates to an automatic teller machine (ATM) that can read various information from a medium, a terminal device, and a medium reading method.

BACKGROUND ART

The techniques disclosed in Patent Documents 1 to 3 are known as techniques relating to data reading by this type of automatic teller machine.

In the customer operation type terminal device disclosed in Patent Document 1, a placement area for a reading object such as a form or an identification card is provided on the screen of the customer operation display unit. A reading means such as a direct scanner or an electronic camera for reading, from above this placement area, display information shown on the reading object is arranged.

The self-POS system (point of sale system) disclosed in Patent Document 2 includes a fixed scanner provided for reading a barcode of a product, and an electronic money multi-reader (a non-contact IC card reader compatible with a plurality of standards) provided on an upper portion of this fixed scanner so as to protrude forward.

In the image forming device disclosed in Patent Document 3, a user, by holding up a mobile terminal such as his/her own smartphone or the like so as to face a communication unit on the main body of the device, transmits data stored in the mobile terminal to the device main body by near field communication (NFC).

PRIOR ART DOCUMENTS

Patent Documents

[Patent Document 1] Japanese Unexamined Patent Application, First Publication No. 2005-184361

[Patent Document 2] Japanese Unexamined Patent Application, First Publication No. 2012-59301

[Patent Document 3] Japanese Unexamined Patent Application, First Publication No. 2014-106481

SUMMARY OF THE INVENTION

Problem to be Solved by the Invention

Patent Documents 1 to 3 disclose techniques for reading information contained in a recording medium with a data reading device provided in a device.

However, the recording medium read by the data reading device includes various forms of information such as display information that is visible by eyes and storage information that is stored as electronic data.

For this reason, in the technologies disclosed in Patent Documents 1 to 3, it is necessary to provide various data reading units corresponding to these various forms of information, and as a result the problem arises of the configuration becoming complicated.

An automatic teller machine (ATM) to which Patent Documents 1 to 3 can be applied is arranged in a narrow space. For this reason, the places where the reading devices can be arranged are limited. Therefore, realizing the acquisition of a plurality of types of information in a narrow space is sought.

The present invention was achieved in view of the above circumstances, and an example object of the present invention is to provide an automatic teller machine, a terminal device, and a medium reading method capable of solving any of the problems described above.

Means for Solving the Problem

An automatic teller machine according to an example aspect of the present invention includes: a first reading sensor that reads display information displayed on a medium at a predetermined position; and a second reading sensor that reads, from the medium at the predetermined position, storage information stored in the medium. The first reading sensor is disposed above the second reading sensor.

A terminal device according to an example aspect of the present invention includes: a first reading sensor that reads display information displayed on a medium at a predetermined position; and a second reading sensor that reads, from the medium at the predetermined position, storage information stored in the medium. The first reading sensor is disposed above the second reading sensor.

A medium reading method according to an aspect example aspect of the present invention includes: reading display information displayed on a medium at a predetermined position, by a first reading sensor; and reading, from the medium at the predetermined position, storage information stored in the medium, by a second reading sensor. The first reading sensor is disposed above the second reading sensor.

Effect of the Invention

According to an example embodiment of the present invention, since a first reading sensor that reads display information of a medium at a predetermined position is disposed above a second reading sensor that reads storage information of the medium at the predetermined position, it is possible to read various forms of information in a limited installation space.

EXAMPLE EMBODIMENTS FOR CARRYING OUT THE INVENTION

First Example Embodiment

Figure 1:
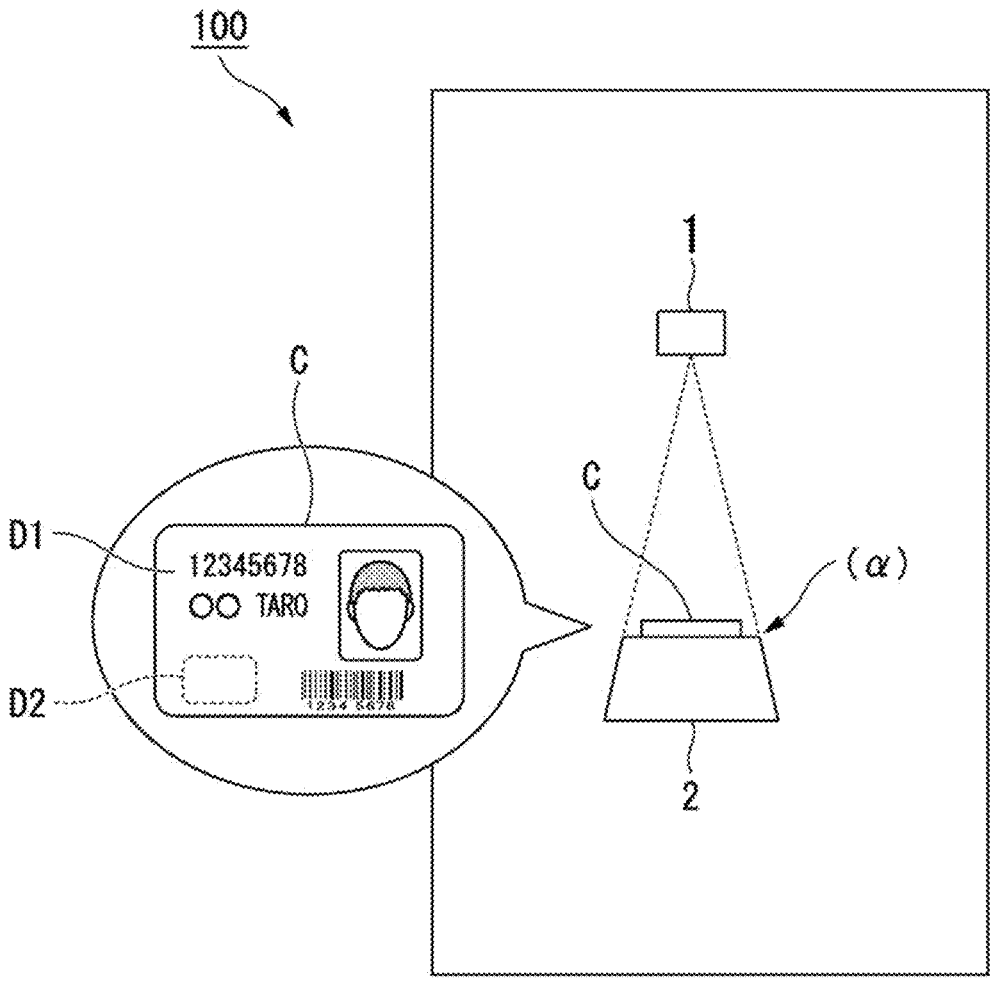
FIG. 1 is a diagram showing a schematic configuration of an automatic teller machine according to a first example embodiment of the present invention.

An automatic teller machine 100 according to a first example embodiment of the present invention will be described with reference to FIG. 1. The automatic teller machine 100 is an example of a terminal device. Hereinbelow, the automatic teller machine 100 will be described as a specific example, but the example embodiment of the present invention is not limited to being applied to an automatic teller machine. The example embodiment of the present invention may be applied to various terminal devices.

The automatic teller machine 100 includes a first reading sensor 1 and a second reading sensor 2. The first reading sensor 1 reads display information D1 displayed on the surface of a recording medium (medium) C at a reading position (α) serving as a predetermined position. The second reading sensor 2 reads storage information D2 stored in the recording medium C. Both the display information D1 and the storage information D2 are included in the recording medium C.

The first reading sensor 1 is arranged above the second reading sensor 2.

According to the automatic teller machine 100 configured as described above, the first reading sensor 1 that reads the display information D1 displayed on the recording medium C at the reading position (α) and the second reading sensor 2 that reads the storage information D2 stored in the recording medium C are provided, and the first reading sensor 1 is disposed above the second reading sensor 2.

Thereby, for example, by providing at the reading position (α) an optical reading device such as a scanner camera or a barcode reader as the first reading sensor 1, and a storage data reading device such as a near field communication device (NFC) or the like as the second reading sensor 2, it is possible to acquire a large amount of information at the reading position (α).

That is, in the automatic teller machine 100 according to the first example embodiment, various forms of information such as the display information D1 and the storage information D2 of the recording medium C can be read at the reading position (α). As a result, according to the automatic teller machine 100, the limited installation space can be effectively used, and the size of the entire device can be reduced.

Furthermore, in the first example embodiment, since a plurality of types of information can be acquired from the same reading position (α), greater convenience can be provided to the user as compared with a configuration in which information is acquired at different positions for each type of information.

In addition, in the related art, there are cases of needing to change the reading position for each of a plurality of types of information. In such a case, the recording medium may be changed to another recording medium for each reading position. In contrast, in the first example embodiment, since it is not necessary to change the reading position for each of a plurality of types of information, it is possible to prevent changing of the recording medium for each of a plurality of types of information. For this reason, according to the first example embodiment, since a plurality of types of information can be more reliably acquired from the same recording medium, use of an unauthorized recording medium can be recognized with higher accuracy, and so there is the advantage of an improvement in security being expected.

Second Example Embodiment

An automatic teller machine 101 according to a second example embodiment of the present invention will be described with reference to FIGS. 2A to 6. The automatic teller machine 101 is an example of a terminal device. Hereinbelow, the automatic teller machine 101 will be described as a specific example, but the example embodiment of the present invention is not limited to being applied to an automatic teller machine. The example embodiment of the present invention may be applied to various terminal devices.

Figure 2A:
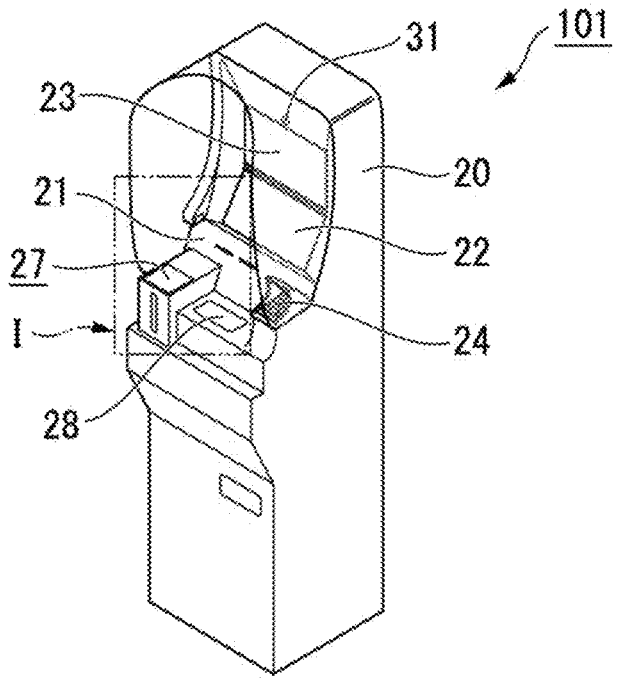
FIG. 2A is a diagram showing an entire automatic teller machine according to a second example embodiment of the present invention.
Figure 2B:
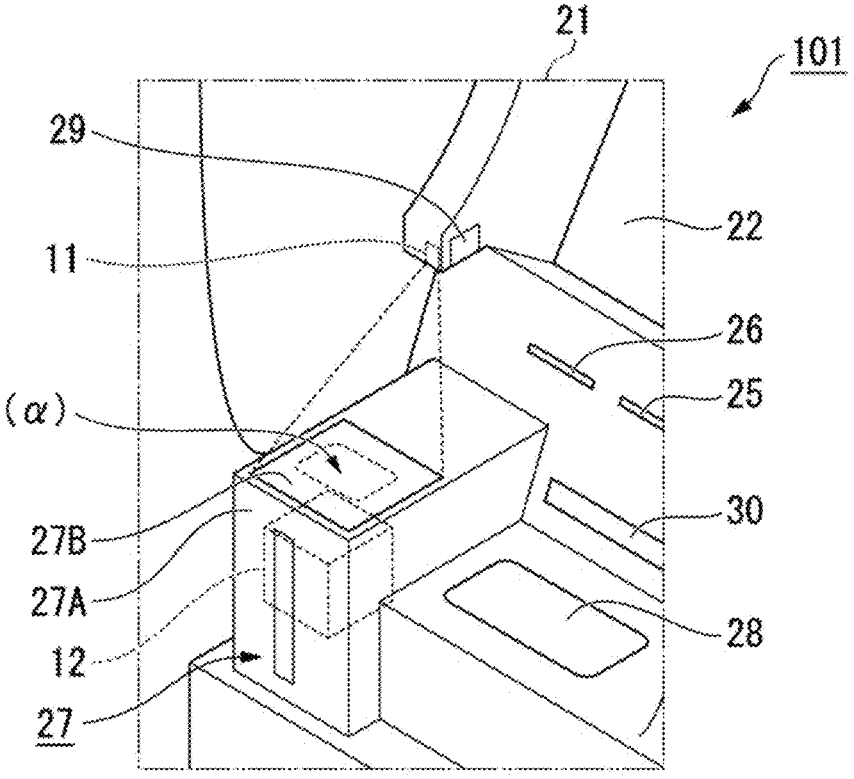
FIG. 2B is an enlarged view of the operation unit of the automatic teller machine shown in FIG. 2A (the portion of reference symbol I in FIG. 2A).

FIG. 2A is a diagram showing the entire automatic teller machine 101. FIG. 2B is an enlarged view of the operation unit of FIG. 2A.

The automatic teller machine 101 includes a device main body unit 20 that performs cash deposit and withdrawal processing, and an operation unit 21 provided on the front surface side of the device main body unit 20 and capable of cash receiving and dispensing operations.

The operation unit 21 includes a first panel 22 and a second panel 23 provided at an upper position of the device main body unit 20. The operation unit 21 includes a numeric keypad 24, a card insertion slot 25, a receipt slot 26, a recording medium reading unit 27, a bill delivery port 28, a detection camera (a skimmer detection camera, a first imaging means, a first imaging unit, a first imaging device) 29 and a human sensor 30 that are provided at the middle position of the device main body unit 20. Further, the operation unit 21 has a monitoring camera (a second imaging means, a second imaging portion, a second imaging device) 31.

The first panel 22 is a touch-type operation panel that is operated by the user.

The second panel 23 is located on the upper side of the first panel 22. The second panel 23 is a display that indicates to the user that the automatic teller machine 101 is an automatic teller machine, and that shows usable card information and the like.

The card insertion slot 25 is an opening unit for inserting a card used for depositing and withdrawing bills.

The bill delivery port 28 is a bill opening for the input and dispensing of bills, and when a shutter (not shown) opens, bills are inserted or removed by the user. The bill delivery port 28 may be an example of a paper sheet input port.

The detection camera 29 is an imaging device provided for monitoring for fraudulent activities at or in the vicinity of the card insertion slot 25 and the bill delivery port 28.

This detection camera 29 monitors for fraudulent activities near the card insertion slot 25 or the like. The detection camera 29 reads display information D1 of a recording medium C arranged at the reading position (α) of the recording medium reading unit 27 from a direction different from the reading direction of a first reading sensor 11 (described below). For example, the detection camera 29 may capture images for monitoring the installation of a skimmer near the card insertion slot 25.

The human sensor 30 is a detector for detecting whether or not a user is in front of the operation unit 21.

The monitoring camera 31 is an imaging device provided on the front surface of the operation unit 21. The monitoring camera 31 captures an image of a user standing in front of the operation unit 21 when the human sensor 30 detects a person.

The face information acquired by the monitoring camera 31 can be compared with the face information in the display information D1 of the recording medium C read by the first reading sensor 11 (described below).

A data processing device, a money receiving and dispensing device, a printing device, and the like are installed in the device main body unit 20. The data processing device processes information input via the first panel 22, the numeric keypad 24, the card insertion slot 25, and the recording medium reading unit 27. The money receiving and dispensing device performs receiving/dispensing of bills into/from the bill delivery port 28 and charging and the like on the basis of signals from the data processing device. The printing device prints receipts to be output from the receipt slot 26.

Next, the recording medium reading unit 27 installed in the operation unit 21 will be described with reference to FIGS. 2B to 6.

The recording medium reading unit 27 includes the first reading sensor 11 and a second reading sensor 12, as shown in FIG. 2B. The first reading sensor 11 reads display information D1 displayed on the surface of the recording medium C arranged at the reading position (α) serving as a predetermined position. The second reading sensor 12 reads storage information D2 stored in the recording medium C arranged at the reading position (α).

The recording medium reading unit 27 is provided with a pedestal 27A serving as a reading unit main body. At the reading position (α) on the upper surface of the pedestal 27A, the recording medium C is placed, touched, or held by the user manually. The pedestal 27A supports from below the recording medium C placed on the upper surface thereof.

The first reading sensor 11 is disposed above the second reading sensor 12 separated from the pedestal 27A, and is installed so as to face the second reading sensor 12. The first reading sensor 11 reads, from above, display information D1 displayed on the surface of the recording medium C.

An optical reading device such as a scanner camera and a barcode reader is installed as the first reading sensor 11. The first reading sensor 11 may include both a scanner camera and a barcode reader. The first reading sensor 11 may include only one of a scanner camera and a barcode reader.

When the first reading sensor 11 is a camera, it is preferable that the first reading sensor 11 be separated from the recording medium C by a predetermined distance or more. That is, it is preferable that the first reading sensor 11 be separated from the upper surface of the pedestal 27A on which the recording medium C is arranged by a predetermined distance or more. The reason is that when the distance between the camera of the first reading sensor 11 and the recording medium C is long, the recording medium C can be easily accommodated within the angle of view of the camera of the first reading sensor 11.

The second reading sensor 12 is built into the pedestal 27A. The second reading sensor 12 reads, from below, the storage information D2 stored in the recording medium C.

A storage data reading device is installed as the second reading sensor 12. The storage data reading device may be a near field communication device (NFC) or an antenna of an NFC.

When the second reading sensor 12 is an NFC, it is preferable that the second reading sensor 12 be arranged near the recording medium C. That is, it is preferable that the second reading sensor 12 be arranged near the upper surface of the pedestal 27A on which the recording medium C is arranged. The reason is that when the distance between the NFC (the antenna thereof) of the second reading sensor 12 and the recording medium C is short, the NFC of the second reading sensor 12 can read the storage information D2 much easily.

As described above, when the first reading sensor 11 is a camera, it is preferable that the first reading sensor 11 be away from the recording medium C (the upper surface of the pedestal 27A). When the second reading sensor 12 is an NFC, it is preferable that the second reading sensor 12 be arranged near the recording medium C (the upper surface of the base 27A). Therefore, when the first reading sensor 11 is a camera and the second reading sensor 12 is an NFC, the distance between the first reading sensor 11 and the recording medium C (the upper surface of the pedestal 27A) is preferably longer than the distance between the second reading sensor 12 and the recording medium C (the upper surface of the pedestal 27A).

A guidance display unit 27B for providing guidance to the user is provided on the pedestal 27A of the recording medium reading unit 27.

The guidance display unit 27B is installed at the upper edge portion of the pedestal 27A. As the guidance display unit 27B, a display device such as a liquid crystal display (LCD) capable of providing a user with guidance on the recording medium C may be used. The guidance relating to the recording medium C may be, for example, guidance indicating the position at which the recording medium C is to be placed, guidance prompting placement or touch, or guidance indicating that the recording medium C cannot be used. The guidance regarding the recording medium C may be a still image or a moving image. In the example shown in FIG. 2B, the guidance display unit 27B displays with a dotted line a frame indicating the position where the card that is the recording medium C is to be placed as guidance.

Next, the recording medium C read by the recording medium reading unit 27 will be described with reference to FIGS. 3A, 3B, and 4.

Figure 3A:
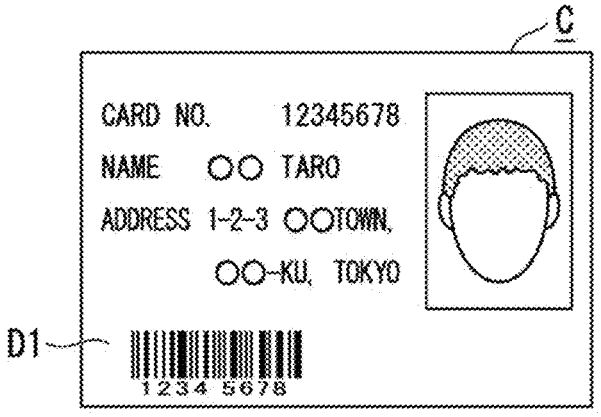
FIG. 3A is a diagram showing the front side of an IC (Integrated Circuit) card shown as an example of the recording medium C.
Figure 3B:
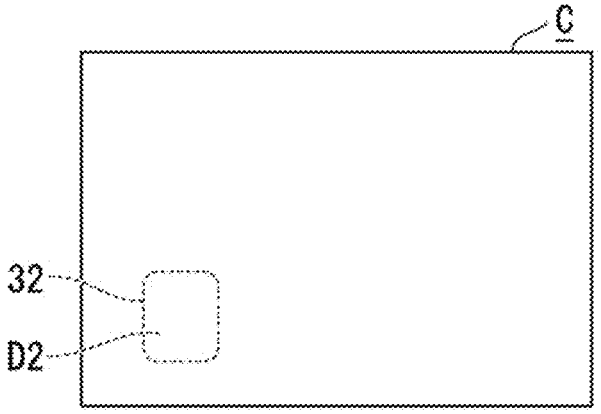
FIG. 3B is a diagram showing the back side of the IC card shown in FIG. 3A.

FIGS. 3A and 3B are diagrams showing the front and back surfaces of an IC card as an example of the recording medium C. FIG. 3A shows the front surface (first surface) of the IC card. On the front surface of the IC card, display information D1 that can be read by the first reading sensor 11 including an optical reading device such as a scanner camera and a barcode reader is shown. The display information D1 may be a card number, a name, an address, a barcode, a face photograph, and the like.

FIG. 3B shows the back surface (second surface) of the IC card. FIG. 3B shows an IC chip 32 that can be read by the second reading sensor 12 including a storage data reading device such as a near field communication device (NFC). The IC chip 32 is embedded in the recording medium C. The integrated circuit of the IC chip 32 stores the storage information D2. The storage information D2 may store information necessary for a transaction in the ATM, such as an account number or a credit card number. The storage information D2 may include information related to the display information D1 on the recording medium C, for example, information indicating an account number or a user's face.

The recording medium C may be any of various electronic money cards, a cash card, a point card, an Individual Number Card, a driver's license, a passport, various slips such as bills and money transfer forms, a smartphone, an IC chip, and the like.

Figure 4:
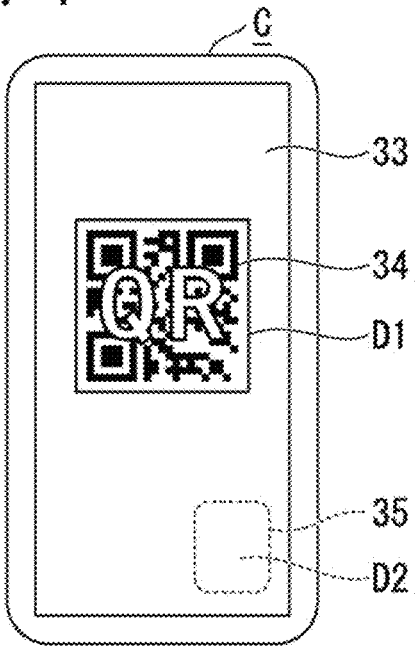
FIG. 4 is a diagram showing a smartphone shown as an example of a recording medium C.

FIG. 4 shows a smartphone as an example of the recording medium C. In the display image 33 on the front side of the smartphone, a QR (QuickResponse) code (registered trademark) 34 readable by the first reading sensor 11 is displayed as the display information D1.

An IC chip 35 having storage information D2 readable by the second reading sensor 12 is built into the smartphone.

The user can cause the first reading sensor 11 to read the display information D1 by displaying on the display image 33 of the smartphone the QR code 34 compatible with electronic money or the like, and turning the QR code 34 toward the first reading sensor 11. Similarly, the user can cause the second reading sensor 12 to read the storage information D2 by placing, holding, or touching the IC chip 35 on the back of the smartphone on/over the second reading sensor 12 in the recording medium reading unit 27.

Next, an information management unit 40 of the automatic teller machine 101 will be described with reference to FIG. 5.

Figure 5:
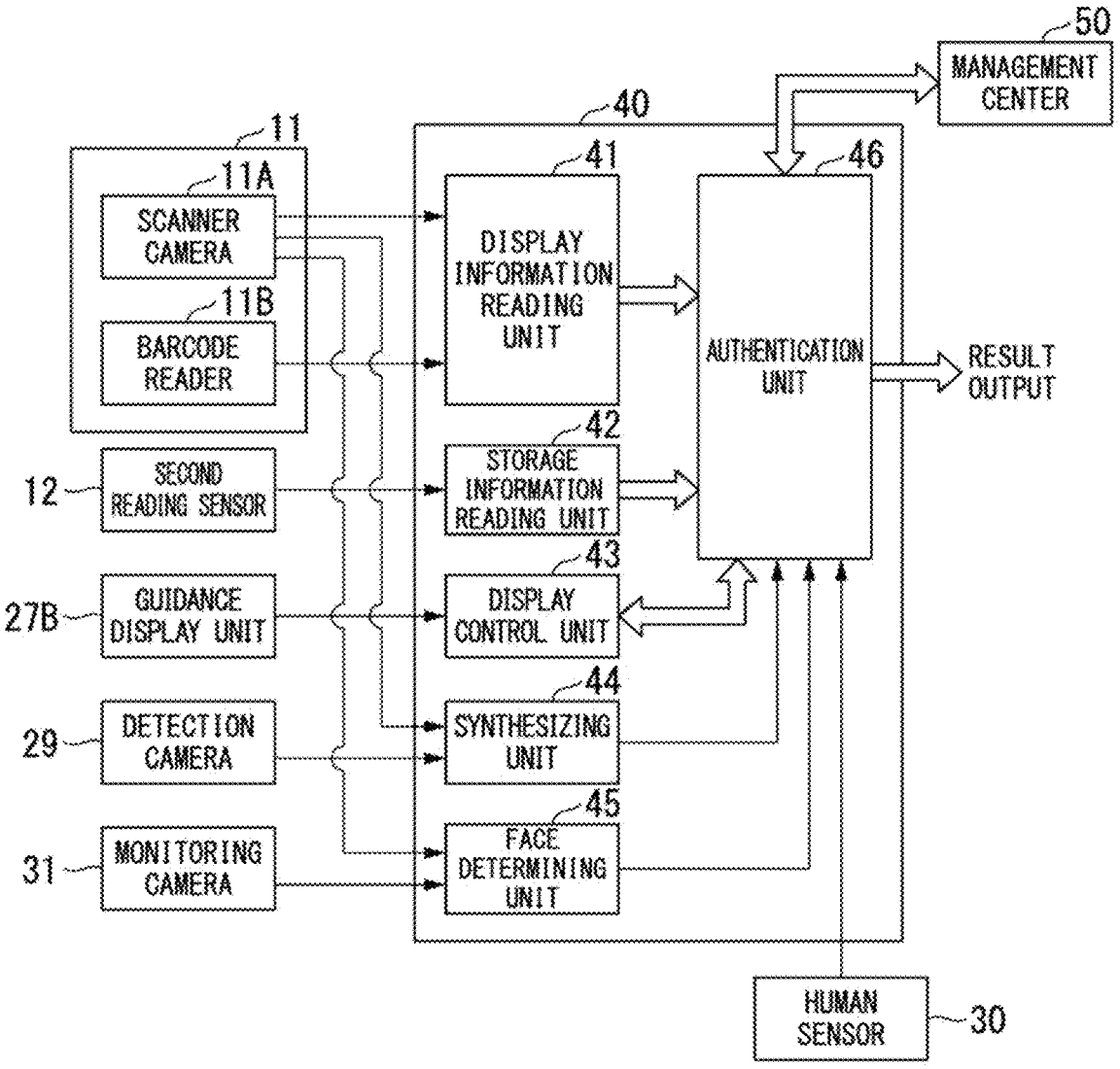
FIG. 5 is a block diagram mainly showing an information management unit of the automatic teller machine shown in FIG. 2A.

As shown in FIG. 5, the automatic teller machine 101 includes the information management unit 40, which manages the medium information read by the recording medium reading unit 27. The information management unit 40 includes a display information reading unit 41, a storage information reading unit 42, a display control unit 43, a synthesizing unit 44, a face determining unit (determining portion) 45, and an authentication unit 46. The information management unit 40 may be realized by a processor such as a CPU (Central Processing Unit) executing a program that realizes functions of the display information reading unit 41 and the like.

In the example shown in FIG. 5, the first reading sensor 11 has a scanner camera 11A and a barcode reader 11B.

The display information reading unit 41 causes the first reading sensor 11 to read the display information D1 of the recording medium C disposed at the reading position (α) of the recording medium reading unit 27 in a state in which the human sensor 30 has been turned on (a state in which the human sensor 30 detects a person). The installation of the human sensor 30 is not essential, and the display information reading unit 41 may cause the first reading sensor 11 to read the display information D1 at an arbitrary timing.

The storage information reading unit 42 causes the second reading sensor 12 to read the storage information D2 of the recording medium C arranged at the reading position (α) of the recording medium reading unit 27 in a state in which the human sensor 30 is turned ON. The installation of the human sensor 30 is not essential, and the storage information reading unit 42 may also cause the second reading sensor 12 to read the storage information D2 at an arbitrary timing.

The display control unit 43 causes the guidance display unit 27B to perform various displays. For example, when the human sensor 30 is turned ON, the display control unit 43 causes the guidance display unit 27B to display guidance such as "Please place a medium on the recording medium reading unit". The installation of the human sensor 30 is not essential, and the display control unit 43 may cause the guidance display unit 27B to perform various displays at an arbitrary timing. In addition, in accordance with the reading result by the display information reading unit 41 and the storage information reading unit 42, the display control unit 43 causes the guidance display unit 27B to display guidance such as "Cannot read" and "Please perform an operation on the first panel".

The synthesizing unit 44 causes the first reading sensor 11 of the recording medium reading unit 27 and the detection camera 29 to read the display information D1 of the recording medium C arranged at the reading position (α) of the recording medium reading unit 27. Further, the synthesizing unit 44 synthesizes these pieces of information to generate an image of the front surface of the recording medium C. The synthesizing unit 44 is provided in order to reduce reading errors by the first reading sensor 11 of the recording medium reading unit 27 as much as possible. For example, light such as fluorescent light may be reflected on the recording medium C. The effect of the reflection of light differs depending on the imaging direction. Here, the imaging direction of the first reading sensor 11 and the imaging direction of the detection camera 29 differ. Therefore, when a part of the image on the front surface of the recording medium C read by the first reading sensor 11 is incomplete due to the reflection of light, the incomplete portion may be compensated for by the image of the front surface of the recording medium C read by the detection camera 29.

The face determining unit 45 determines whether or not the user's face image acquired by the monitoring camera 31 matches the face image of the display information D1 acquired by the first reading sensor 11 of the recording medium reading unit 27. When the face determining unit 45 determines that the user's face image acquired by the monitoring camera 31 does not match the face image of the display information D1 acquired by the first reading sensor 11 of the recording medium reading unit 27, it cancels the transaction using the recording medium C. This is because if the face image of the user acquired by the monitoring camera 31 does not match the face image of the display information D1 acquired by the first reading sensor 11 of the recording medium reading unit 27, there is a possibility that the recording medium C is being used by an invalid user.

Figure 6:
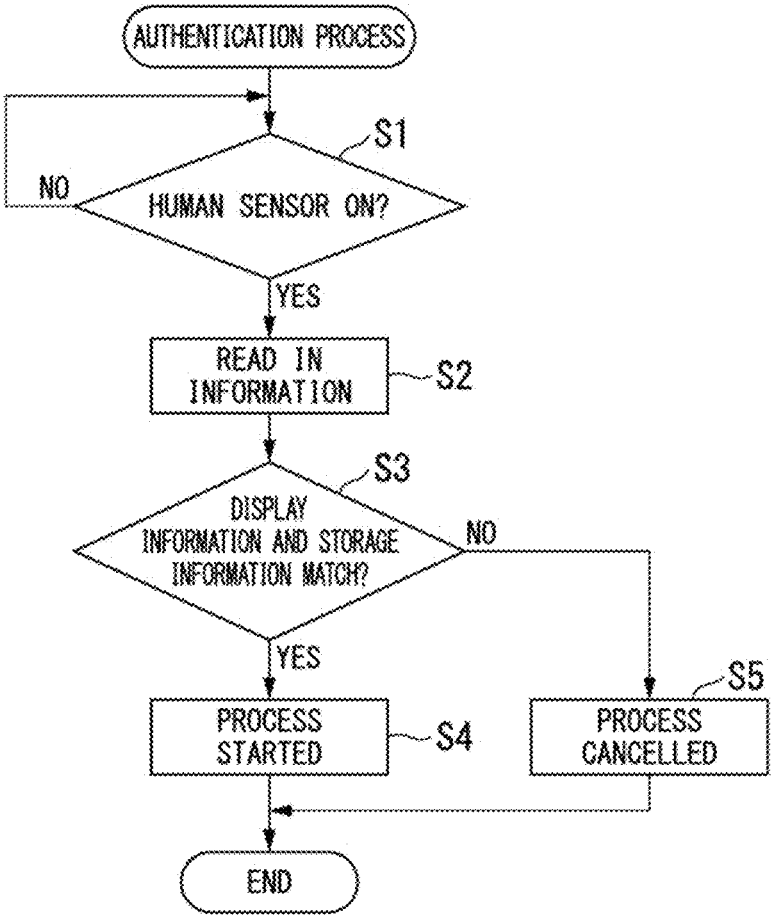
FIG. 6 is a diagram showing the control flow by the information management unit shown in FIG. 5.

Next, a description will be given for each step S of the control flow of the authentication unit 46 of the information management unit 40, referring to FIG. 6.

(Step S1)

The authentication unit 46, upon detecting that a user has approached the operation unit 21 of the automatic teller machine 101 by a detection of the human sensor 30, puts the reading sensors 11 and 12 of the recording medium reading unit 27, the detection camera 29 serving as the first imaging device and the monitoring camera 31 serving as the second imaging device in a standby state capable of performing reading.

(Step S2)

When the user has placed the recording medium C at the reading position (α) of the recording medium reading unit 27, the first reading sensor 11 of the recording medium reading unit 27 acquires the display information D1 of the recording medium C, and/or the second reading sensor 12 acquires the storage information D2 of the recording medium C. At the same time, the detection camera 29 and the monitoring camera 31 also collect necessary information.

(Step S3)

The authentication unit 46 determines whether or not the display information D1 and the storage information D2 of the recording medium C acquired in Step S2 match. If the display information D1 and the storage information D2 of the recording medium C match (YES in Step S3), the authentication unit 46 determines that the recording medium C is normal (authentic, genuine), and proceeds to Step S4. If the display information D1 and the storage information D2 of the recording medium C do not match (NO in Step S3), the authentication unit 46 determines that the recording medium C is not normal (authentic, genuine), and proceeds to Step S5.

For example, when the recording medium C is a cash card, the authentication unit 46 authenticates the cash card by comparing the account number included in the display information D1 with the account number included in the storage information D2 to determine whether there is a match. More specifically, when the account number included in the display information D1 and the account number included in the storage information D2 match, the authentication unit 46 determines that the cash card is normal. If the account number included in the display information D1 and the account number included in the storage information D2 do not match, the authentication unit 46 determines that the cash card is abnormal.

Alternatively, the authentication unit 46 may determine whether to proceed to Step S4 or Step S5 using the result of the user's face determination by the face determining unit 45. For example, the authentication unit 46 proceeds to Step S4 only in the case of having determined that the recording medium C is normal, and when the face image of the user acquired by the monitoring camera 31 matches face image of the display information D1 acquired by the first reading sensor 11 of the recording medium reading unit 27. On the other hand, even when the authentication unit 46 determines that the recording medium C is normal, if the face image of the user acquired by the monitoring camera 31 does not match the face image of the display information D1 acquired by the first reading sensor 11 of the recording medium reading unit 27, the process proceeds to Step S5.

The authentication unit 46 may determine whether or not the recording medium C is normal by making an inquiry about the display information D1 and/or the storage information D2 to a management center (external device) 50 connected to the automatic teller machine 101 via a network, in addition to or alternatively to determining whether or not the display information D1 and the storage information D2 of the recording medium C match.

(Step S4)

When the process has proceeded to Step S4, the first panel 22 guides the user to perform operations such as deposit, withdrawal, balance inquiry, charge, and payment according to the operation. Thereafter, the control flow relating to the authentication unit 46 of the recording medium reading unit 27 ends.

(Step S5)

When the process has proceeded to Step S5, the guidance display unit 27B or the first panel 22 performs a display (guidance) indicating that the recording medium C arranged at the reading position (α) of the recording medium reading unit 27 is not accepted. Thereafter, the control flow relating to the authentication unit 46 of the recording medium reading unit 27 ends.

According to the automatic teller machine 101 configured as described above, the first reading sensor 11 that reads the display information D1 displayed on the recording medium C at the predetermined reading position (α) and the second reading sensor 12 that reads storage information D2 stored in the recording medium C are provided, and the first reading sensor 11 is disposed above the second reading sensor 12.

Thereby, in the automatic teller machine 101, for example, at the reading position (α) of the recording medium reading unit 27, an optical reading device such as a scanner camera or a barcode reader is provided as the first reading sensor 11, and a storage data reading device such as a near field communication device (NFC) is provided as the second reading sensor 12. With this configuration, it is possible to acquire a large amount of information at the reading position (α).

That is, in the automatic teller machine 101, various forms of information such as the display information D1 and the storage information D2 stored in the recording medium C can be read at the reading position (α) of the recording medium reading unit 27.

As a result, according to the automatic teller machine 101, the limited installation space can be effectively used, and the size of the entire device can be reduced.

Furthermore, in the second example embodiment of the present invention, since a plurality of types of information can be acquired at the same reading position (α), greater convenience can be provided to the user as compared with a configuration in which information is acquired at different positions for each type of information.

In addition, in the related art, it may be necessary to change the reading position for each of a plurality of types of information. In such a case, the recording medium could be changed to another recording medium for each reading position. In contrast, in the second example embodiment, since it is not necessary to change the reading position for each of a plurality of types of information, it is possible to prevent the recording medium from being changed for each of a plurality of types of information. For this reason, according to the second example embodiment, since a plurality of types of information can be more reliably acquired from the same recording medium, use of an unauthorized recording medium can be recognized with higher accuracy, and so there is the advantage of an improvement in security being expected.

Modified Example 1

In the second example embodiment, a plurality of optical reading devices such as a scanner camera and a barcode reader were provided as the first reading sensor 11, but the example embodiment of the present invention is not limited to such a case. The first reading sensor 11 may be implemented by one device by using a high-quality image capturing device or the like.

Modified Example 2

In the second example embodiment, the first reading sensor 11 is described as being disposed above and facing the second reading sensor 12, but the example embodiment of the present invention is not limited to such a case.

For example, the first reading sensor 11 may be arranged so as to be horizontally displaced from the second reading sensor 12 in a range where the recording medium C can be read. The first reading sensor 11 and the second reading sensor 12 may be arranged upside down.

The positions of the first reading sensor 11 and the second reading sensor 12 may be arbitrary as long as the first reading sensor 11 and the second reading sensor 12 are arranged within a range where the recording medium C can be read.

Both the first reading sensor 11 and the second reading sensor 12 may be arranged above the recording medium C. Both the first reading sensor 11 and the second reading sensor 12 may be arranged below the recording medium C. Both the first reading sensor 11 and the second reading sensor 12 may be horizontally offset with respect to the recording medium C.

Although the example embodiments of the present invention have been described in detail above with reference to the drawings, specific configurations are not limited to those example embodiments, and design changes or the like within a range not departing from the scope of the present invention are also encompassed.

Besides, it is possible to appropriately replace the constituent elements in the above example embodiment with well-known constituent elements within a scope not deviating from the gist of the present invention. The technical scope of the present invention is not limited to the example embodiments described above, and various modifications can be made without departing from the spirit of the present invention.

A part or whole of the above-described exemplary example embodiments may be described as, but not limited to, the following supplementary notes.

(Supplementary Note 1)

An automatic teller machine comprising:

a first reading sensor that reads display information displayed on a medium at a predetermined position; and a second reading sensor that reads, from the medium at the predetermined position, storage information stored in the medium, wherein the first reading sensor is disposed above the second reading sensor.

(Supplementary Note 2)

The automatic teller machine according to supplementary note 1, wherein the first reading sensor faces the second reading sensor.

(Supplementary Note 3)

The automatic teller machine according to supplementary note 1 or 2, further comprising:

a pedestal that supports the medium at the predetermined position and displays a guide indicating the predetermined position.

(Supplementary Note 4)

The automatic teller machine according to supplementary note 3, wherein the second reading sensor is built into the pedestal.

(Supplementary Note 5)

The automatic teller machine according to any one of supplementary notes 1 to 4, wherein the storage information is stored in an integrated circuit of the medium.

(Supplementary Note 6)

The automatic teller machine according to any one of supplementary notes 1 to 5, wherein the first reading sensor reads the display information from above the medium at the predetermined position, and the second reading sensor reads the storage information from below the medium at the predetermined position.

(Supplementary Note 7)

The automatic teller machine according to any one of supplementary notes 1 to 6, further comprising:

an authentication unit that determines whether the medium is a normal medium by comparing the display information with the storage information.

(Supplementary Note 8)

The automatic teller machine according to any one of supplementary notes 1 to 7, further comprising:

a first imaging unit that reads the recording medium at the predetermined position from an imaging direction different from an imaging direction of the first reading sensor, and a synthesizing unit that synthesizes the display information and the information read by the first imaging unit to generate an image of a surface of the medium.

(Supplementary Note 9)

The automatic teller machine according to supplementary note 8, wherein the first imaging unit images the medium at the predetermined position at the same time as imaging at least one of a card insertion slot and a paper sheet input port.

(Supplementary Note 10)

The automatic teller machine according to any one of supplementary notes 1 to 9, further comprising:

a second imaging unit that images a user to acquire an image of a face of the user; and a determining unit that determines whether the acquired image of the face of the user matches an image of a face included in the display information or the storage information.

(Supplementary Note 11)

A terminal device comprising:

a first reading sensor that reads display information displayed on a medium at a predetermined position; and a second reading sensor that reads, from the medium at the predetermined position, storage information stored in the medium, wherein the first reading sensor is disposed above the second reading sensor.

(Supplementary Note 12)

A medium reading method comprising:

reading display information displayed on a medium at a predetermined position, by a first reading sensor; and reading, from the medium at the predetermined position, storage information stored in the medium, by a second reading sensor, wherein the first reading sensor is disposed above the second reading sensor.

INDUSTRIAL APPLICABILITY

The present invention may be applied to an automatic teller machine, a terminal device, and a medium reading method.

This application is based upon and claims the benefit of priority from Japanese Patent Application No. 2017-237932, filed Dec. 12, 2017, the disclosure of which is incorporated herein in its entirety.

REFERENCE SYMBOLS

1: First reading sensor
2: Second reading sensor
11: First reading sensor
12: Second reading sensor
20: Device main body unit
21: Operation unit
27: Recording medium reading unit
27A: Pedestal
27B: Guidance display unit
29: Detection camera
31: Monitoring camera
C: Recording medium
D1: Display information
D2: Storage information
100: Automatic teller machine

What is claimed is:

1. An automatic teller machine comprising:

a first reading sensor that reads display information displayed on a medium at a predetermined position; and a second reading sensor that reads, from the medium at the predetermined position, storage information stored in an integrated circuit of the medium, wherein the first reading sensor is disposed above the second reading sensor.

2. The automatic teller machine according to claim 1, wherein the first reading sensor faces the second reading sensor.

3. The automatic teller machine according to claim 1, further comprising:

a pedestal that supports the medium at the predetermined position and displays a guide indicating the predetermined position.

4. The automatic teller machine according to claim 3, wherein the second reading sensor is built into the pedestal.

5. The automatic teller machine according to claim 1, wherein the first reading sensor reads the display information from above the medium at the predetermined position, and the second reading sensor reads the storage information from below the medium at the predetermined position.

6. The automatic teller machine according to claim 1, further comprising:

a memory storing instructions; and a processor configured to execute the instructions to:

determine whether the medium is a normal medium by comparing the display information with the storage information.

7. The automatic teller machine according to claim 1, further comprising:

a first camera that reads the recording medium at the predetermined position from an imaging direction different from an imaging direction of the first reading sensor;

a memory storing instructions; and a processor configured to execute the instructions to:

synthesize the display information and the information read by the first camera to generate an image of a surface of the medium.

8. The automatic teller machine according to claim 7, wherein the first camera images the medium at the predetermined position at the same time as imaging at least one of a card insertion slot and a paper sheet input port.

9. The automatic teller machine according to claim 1, further comprising:

a camera that images a user to acquire an image of a face of the user;

a memory storing instructions; and a processor configured to execute the instructions to:

determine whether the acquired image of the face of the user matches an image of a face included in the display information or the storage information.

10. A terminal device comprising:

a first reading sensor that reads display information displayed on a medium at a predetermined position; and a second reading sensor that reads, from the medium at the predetermined position, storage information stored in an integrated circuit of the medium, wherein the first reading sensor is disposed above the second reading sensor.

11. A medium reading method comprising:

reading display information displayed on a medium at a predetermined position, by a first reading sensor; and reading, from the medium at the predetermined position, storage information stored in an integrated circuit of the medium, by a second reading sensor, wherein the first reading sensor is disposed above the second reading sensor.

* * * * *